US005183119A

United States Patent [19]

Wattenburg

[11] Patent Number: 5,183,119

[45] Date of Patent: Feb. 2, 1993

[54] ANTI-SNAG PLOWING SYSTEM

[75] Inventor: Willard H. Wattenburg, Chico, Calif.

[73] Assignee: Regents of the University of California, Oakland, Calif.

[21] Appl. No.: 714,907

[22] Filed: Jun. 14, 1991

[51] Int. Cl.[5] ..... A01D 15/00; A01B 49/02; A01B 43/00

[52] U.S. Cl. ..... 171/105; 89/1.13; 171/2; 171/6; 171/137; 171/144; 172/612; 172/712; 172/34; 172/198

[58] Field of Search ..... 171/2, 6, 18, 137, 141, 171/63, 104, 105, 144; 89/1.13; 172/34, 612, 712, 445.1, 190, 197-199

[56] References Cited

U.S. PATENT DOCUMENTS

| | | | |
|---|---|---|---|
| 2,552,736 | 5/1951 | Rayner | 172/612 |
| 2,860,426 | 11/1958 | Allin, Jr. et al. | 171/105 |
| 3,126,865 | 3/1964 | Wiegardt, Jr. | 172/612 |
| 3,392,790 | 7/1968 | Bestland et al. | 171/63 |
| 4,020,780 | 5/1977 | Shumaker et al. | 89/1.13 |
| 4,021,725 | 5/1977 | Kirkland | 89/1.13 |
| 4,552,053 | 11/1985 | Bar-Nefy et al. | 171/141 |

FOREIGN PATENT DOCUMENTS

| | | | |
|---|---|---|---|
| 48560 | 3/1934 | Denmark | 172/34 |
| 338901 | 10/1989 | European Pat. Off. | 89/1.13 |
| 771343 | 4/1934 | France | 172/34 |
| 60913 | 7/1912 | Switzerland | 172/612 |
| 484155 | 4/1938 | United Kingdom | 172/34 |

OTHER PUBLICATIONS

"To Stop Kuwait's Fires, First Clear the Mines", Science vol. 252, p. 1609, Jun. 1991.

*Primary Examiner*—Randolph A. Reese
*Assistant Examiner*—Spencer Warnick
*Attorney, Agent, or Firm*—Daryl S. Grzybicki; Henry P. Sartorio

[57] ABSTRACT

An anti-snag plowing system suitable for clearing mines in the Middle East is disclosed. Advantageously, the plowing system has also been found to be an efficient and effective soil conditioner, making it a useful farming tool as well. The plowing system comprises several digging-knife units, or plows, and a harrow. Both are attached in tandem to a chain matrix, which is pulled with either a helicopter or tractor. The digging-knife units rotate if the digging-knives hit an immovable snag. The harrow is covered with a chain blanket, and may have magnetic or sonic wave mine triggers if the system is used for clearing mines. A symmetrical embodiment is also disclosed.

26 Claims, 8 Drawing Sheets

ANTI-SNAG PLOWING SYSTEM

BACKGROUND OF THE INVENTION

There currently exists an urgent need to remove hundreds of thousands of mines that have been buried in the desert in the Middle East. The mine-clearing techniques presently in use are expensive and time consuming, as well as dangerous. Tanks with heavy, front-mounted rollers are used to blow up mines, with the rollers having a life expectancy of about two hits. Tanks with front-mounted, V-shaped plows are also used to dig up or detonate buried mines, with the plows having a life expentancy of one hit on each side of the plow. Long line charges are also used in attempts to detonate mines, but these devices do not work well with the sophisticated trigger mechanisms used in modern mines. These mine-clearing techniques are not practical for the large scale removal required now. The situation is complicated further with crude oil covering large areas of mined land.

Others have attempted to use farmer's harrow devices and/or chains to dig out and clear mines, but these have been unsuccessful because they do not dig adequately, and they are easily blown apart.

There thus is a strong demand for a mine-clearing device that is safe, fast, and relatively inexpensive. There is also a demand for a mine-clearing device that can be used in all types of terrain.

In seeking to design a mine-clearing device suitable for extensive use in the Middle East the present inventor has also designed what turns out to be a very effective plowing system that requires only ⅓ the energy of prior art plowing systems for 6"-10" deep ground preparation. Consequently, this has generated considerable interest among farmers.

Obstructions have always been a problem when plowing—blades are bent or broken, rigid supports are bent, and the like. Thus, whether or not one is clearing mines or farming, there is a need for a plow that is not damaged when the blades snag on buried objects that will not readily move.

SUMMARY OF THE INVENTION

It is an object of the present invention to provide a fast, reliable, and inexpensive plow that is suitable for either mine-clearing or farming. The present invention provides an anti-snag plowing system which can be pulled from a safe distance with a helicopter for mine-clearing, or pulled with a tractor for farming.

It is a further object of the present invention to provide a plowing system that uses a modular chain matrix construction that is highly resistant to detonations, and, if damaged, can be easily fixed.

It is still a further object of the present invention to provide a plowing system that comprises a plurality of digging-knife units, each with a set of digging-knives, affixed to the chain matrix in such a way that they will not snag on buried, "immovable" objects. The digging-knives (so called because they resemble bread knives) are specially designed to slice easily through the earth, and to lift buried objects to the surface.

These, and other objects of the invention are realized by using a towing unit such as a tractor or a helicopter to tow a chain matrix that loosely connects digging-knife units and flexible harrow sections so they are towed in tandem. The leading chains in the matrix pull several digging-knife units that form a type of plow.

The digging-knife units in turn pull a harrow via the chain matrix, which advantageously overlaps and forms a chain blanket over the harrow so that any mines that detonate in the vicinity of the harrow will only destroy a small section of the harrow and chain matrix. Without the chain blanket's unique pattern and the surprising amount of reinforcement resulting therefrom, the harrow would be lifted and caught in the main force of a large mine explosion, and a substantial portion, if not the entire harrow, would be displaced and/or destroyed. The unique two-layer chain matrix/harrow design of the present invention has been successfully tested over actual minefields in March 1991.

The digging-knife units have an anti-snag feature that is unique to the present invention. When one of the digging-knife units hits a buried "immovable" object the torque (about the point of contact) exerted on the digging-knife unit from the chains pulling it forward is greater than the torque exerted by the chains pulling it backwards (due to the drag of the harrow). This occurs because the drag from the harrow can vary among the digging-knife units. The invention uses a flexible harrow which has a large amount of "give" when pulled more in one place than in others. The chain matrix design exploits this flexibility so that upon hitting a snag the digging-knife unit is momentarily rotated so the digging-knives are tilted to ride over the object. Once past the immovable object the drag from the harrow forces the knives back into the ground. Damage to the digging-knife units from snags is thus advantageously avoided with the unique design of the present invention. In part, this feature is unique because the towing unit must tow both the digging-knife units and the harrow, so not all of the towing force can be used for plowing with the digging-knife units. Thus, the present invention takes advantage of the added pull on the digging-knife units from the harrow to provide a plowing system with an anti-snag feature. If they are damaged from a mine detonation the units are modular, inexpensive, and easy to replace.

The above features of the present invention will be more clearly understood from the following detailed description of the invention with reference to the drawings.

DESCRIPTION OF THE PREFERRED EMBODIMENTS

Figure 1:
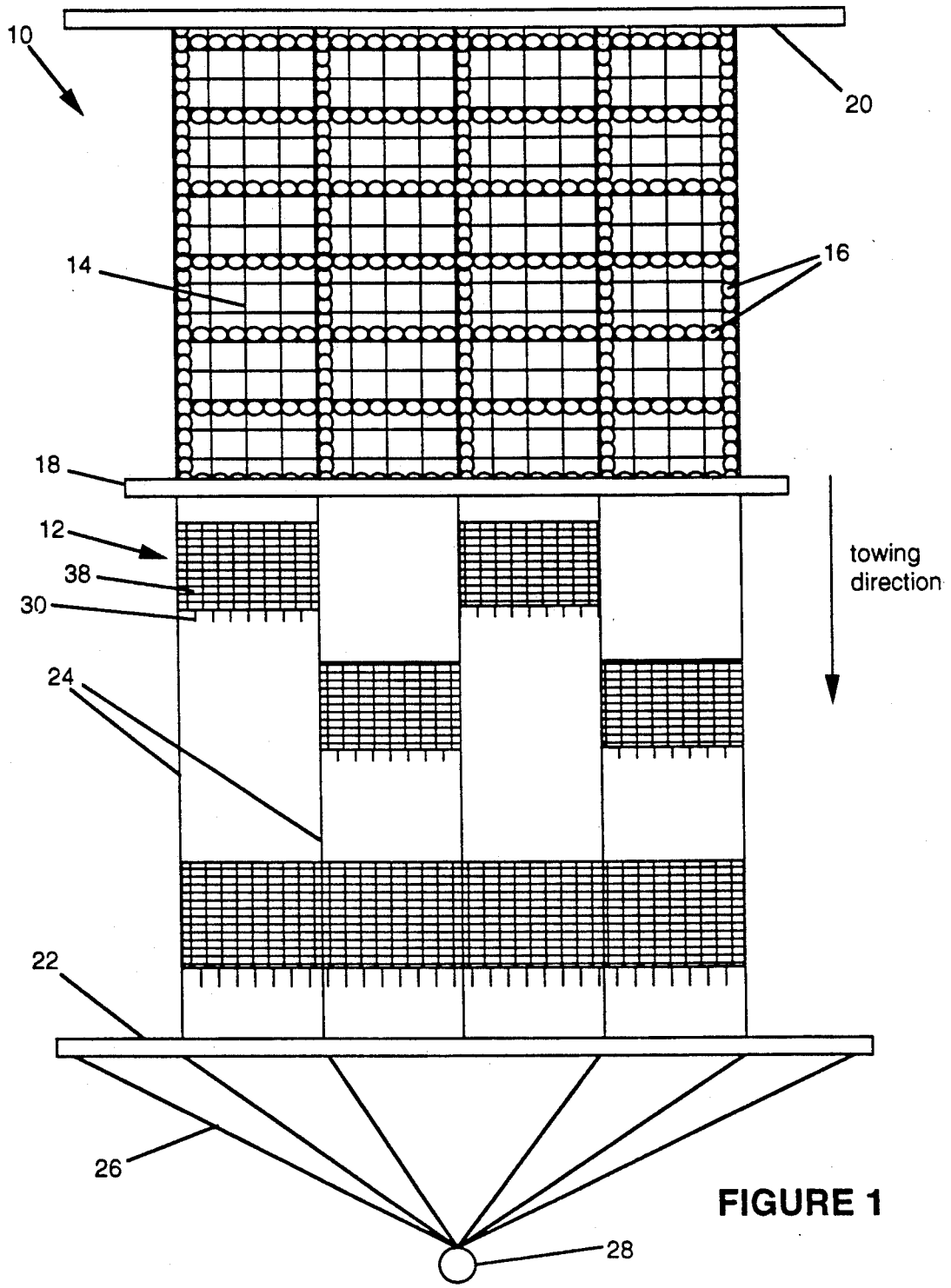
FIG. 1 is a plan view of a complete chain matrix with the attached digging-knife units and harrow according to the present invention.
Figure 1A:
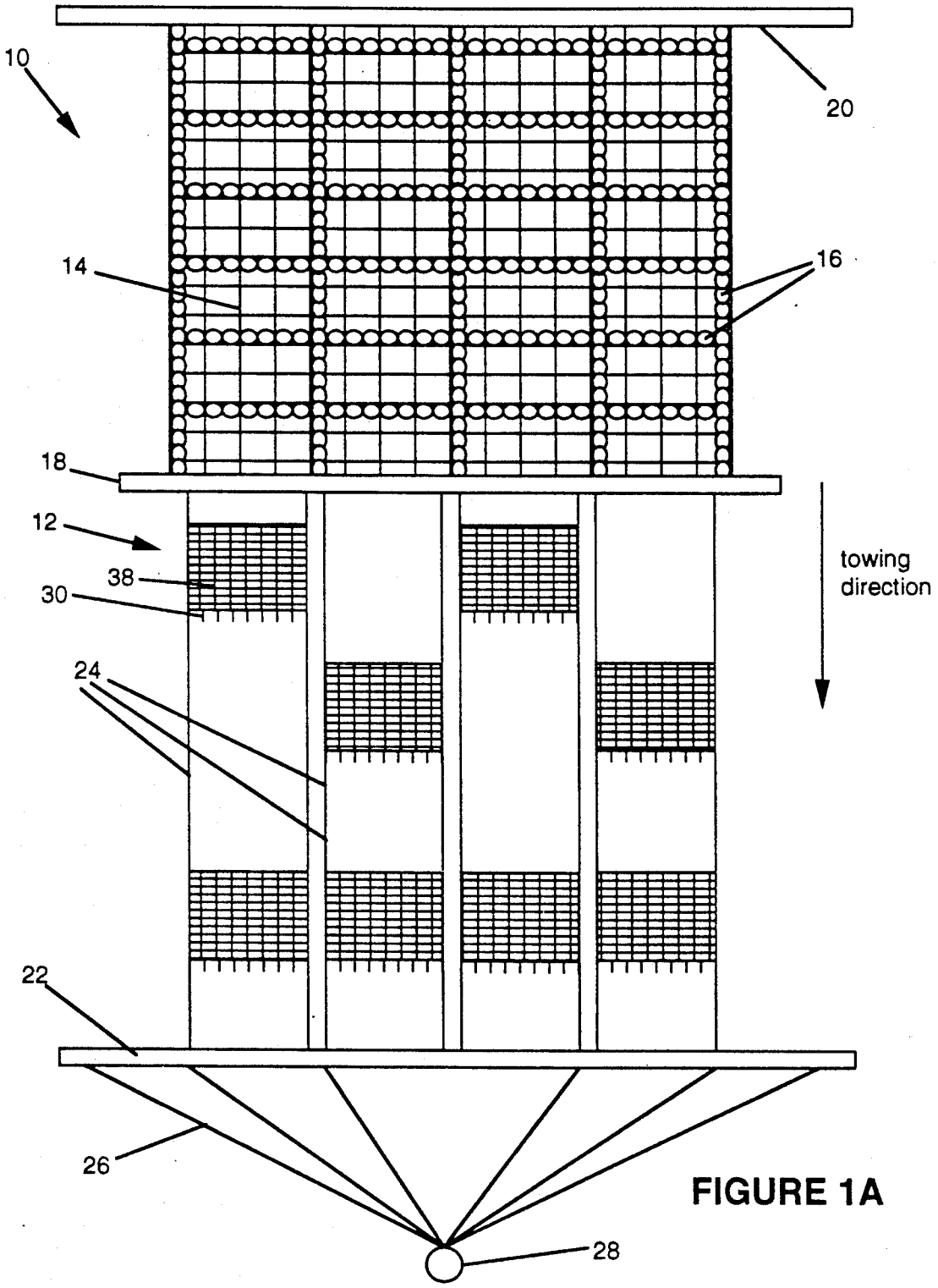
FIG. 1A is a plan view of a complete chain matrix with each row of attached digging knife units having their own pair of side chains.

A single-sided embodiment of the present invention is shown in FIG. 1. Anti-snag plow 10 includes digging-knife units 12 and harrow 14, which has a modular construction and a reinforcing blanket of chains 16. Spreader bars 18 and 20, and draw bar 22 are bolted to a chain matrix that includes side chains 24 and reinforcing chains 16. Draw bar 22 has draw bar cables 26 that end in a fastener 28 for attachment to a helicopter or tractor via a tow line. A unique, major feature of this plow system is that it allows "stand-off" minesweeping by mechanical means for the first time, because the helicopter can easily maneuver and tow the chain matrix on the end of a 400'-800' cable. Ground vehicles may also be used for clearing mines. For instance, two vehicles may tow plow 10 between and behind them if two parallel lanes have already been cleared.

When towed, draw bar 22 pulls on five side chains 24 which are bolted to the front and rear sides of digging-knife units 12. (In operation with a helicopter, the tow cable is long enough to insure draw bar 22 remains close to the ground.) FIG. 1 shows two rows of four digging knife units: one row has staggered or offset units, and the other row has adjacent units. These two arrangements are shown on the same plow for illustrative purposes only. Side chains 24 are bolted in series so the rear of the first row pulls the front of the second row. (Optionally, each digging-knife unit 12 may have individual side chains 24, although weight is a consideration when towing with a helicopter. Also, adjacent digging-knife units may share the same side chain, as in FIG. 1, or they may have separate side chains.) Side chains 24 are attached to harrow 14 (may be attached directly, or via front spreader bar 18) so the rear bolt attachement to the second row of digging-knife units 12 pulls harrow 14.

Front spreader bar 18 and rear spreader bar 20 are attached to harrow 14 and chains 16. Chains 16 are patterned to form a reinforcement for harrow 14 that dramatically reduces the damage sustained from a mine detonation. If harrow 14 is not covered with a chain blanket it is lifted and torn apart by the blast. It was found that the unexpected protection provided by chains 16 occurs because the extra reinforcement they provide is sufficient to prevent harrow 14 from being lifted by the explosion. Consequently, most of the energy and momentum from the mine explosion escapes before it can spread through the harrow's loose lattice-like structure, and only local damage is sustained. This may be easily repaired because harrow 14 has a modular construction of 1 m×2 m sections. Of course, chain blanket 16 is not required for farming.

In a preferred embodiment all chain sections are ⅜", high test schedule 70, and are 16' long. Side chains 24 in the embodiment of FIG. 1 are one chain section long. All chain attachments are made with simple chain loops and bolts so repair is simple.

Draw bar 22 has a 4" diameter, and front spreader 18 and rear spreader 20 are 3" and 4", respectively. All bars are schedule 40. The metal bars have small chain loops or eyelets welded in the locations where they are fastened to the loops at the ends of the chains.

Harrow 14 is made in England by Parmiter & Sons, Inc., and it comes in 1 m×2 m sections to form a harrow approximately 15'×30' for the present invention. The sections fit together with hooks to make a harrow with any desired size. This particular type of harrow is preferred because it has a great deal of flexibility.

Figure 2:
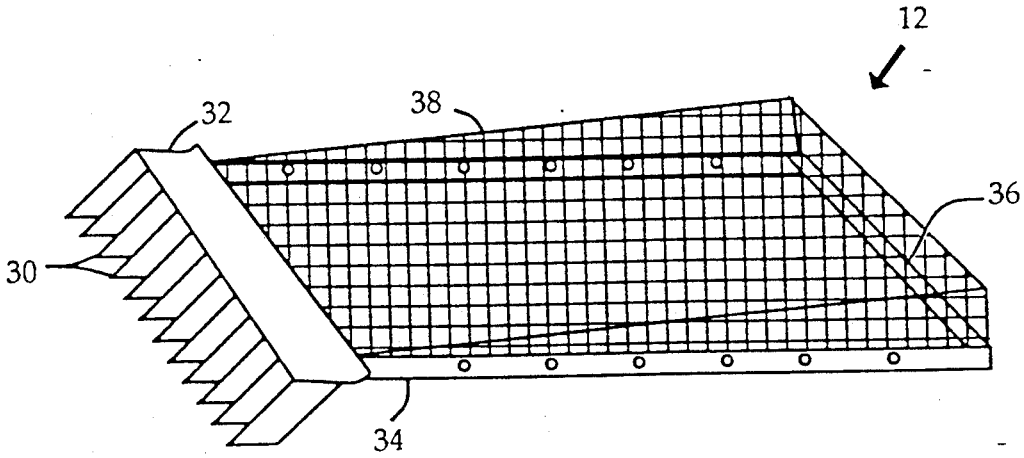
FIG. 2 is a schematic of a digging-knife unit in accordance with the present invention.

FIG. 2 shows a digging-knife unit 12 according to the present invention. Each digging-knife 30 is ¼"-⅜" thick by 3"-4" wide bevel-edge plow steel. Digging-knives 30 are 6"-12" long, or even longer depending on the soil. They preferably form a 28-30 degree forward angle with the vertical when plowing. Top bracket 32 is 4"×1"×⅜" angle iron, or 5" wide flat bar rolled up slightly to form a streamlined surface for the dirt to flow over. Digging-knives 30 are butt welded on both sides to top bracket 32. Side brackets 34 and back bracket 36 are 3"×3"×¼" angle iron. Side brackets 34 are 4'-8' long, and top bracket 32 and back bracket 36 are about 40" long in the present embodiment. "Mine-catching" basket 38 has approximately 3" mesh. Basket 38 may be used to catch debris that digging-knives 30 turn up, which in tests is virtually everything larger than the preferred 4" spacing between them. If two rows of digging-knife units 12 are used, as in FIG. 1, digging-knives 30 in the second row may be made deeper than the digging knives in the first row.

Figure 3:
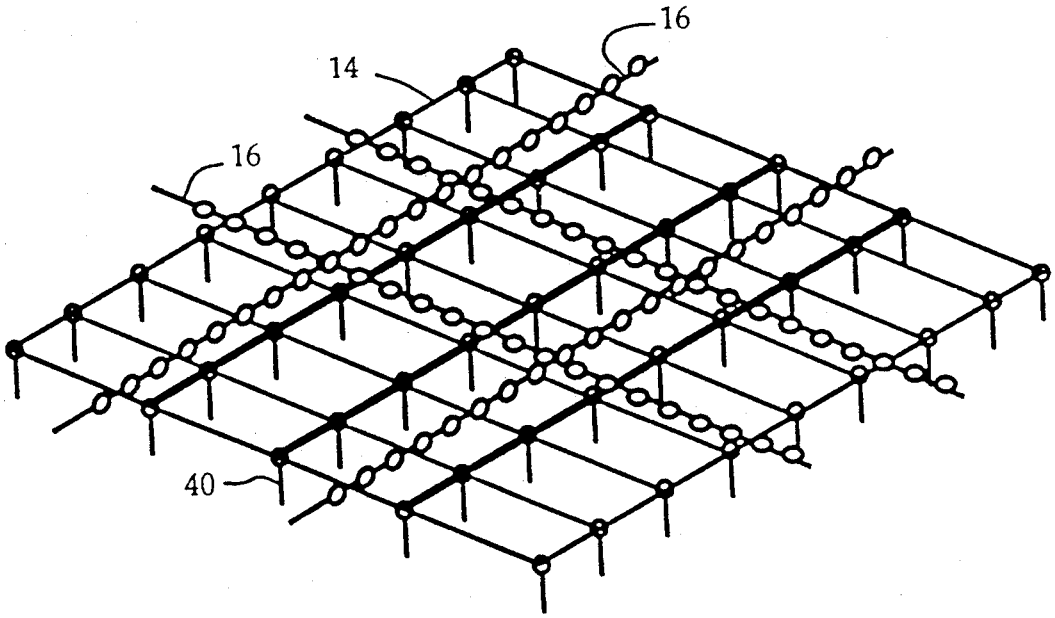
FIG. 3 is a schematic of the harrow drag with reinforcing chains according to the present invention.

A detail of harrow 14 and reinforcing chains 16 is shown in FIG. 3. Chains 16 running lengthwise are spaced the same as side chains 24, or about 40". This facilitates connections along front spreader bar 18. Cross-chains 16 are spaced at 4'-8' intervals. Harrow 14 is made of ½"-⅜" wire rod bent to form an interlocking pattern with wire ends bent down to form tines 40 that are 2"-6" long, and spaced about every 8". Harrow 14 has a large amount of flexibility due to the loose connections at the joints.

If plow 10 is made as described, with 6" digging-knives and 3" tines, the entire unit weighs about 4000 pounds. A Vertol 107II helicopter was able to pull it at about 10 mph through rocky soil with about 10,000 pounds of towing force. Of this, about 4000 pounds was due to the drag from the digging-knives, and about 6000 pounds was due to the drag from the harrow. The plow performed superbly, with everything larger than 4" (the spacing between the digging-knives) pulled up, and there were no broken digging-knives. Imitation mines were also buried at typical depths, and all of these were pulled up.

Figure 4:
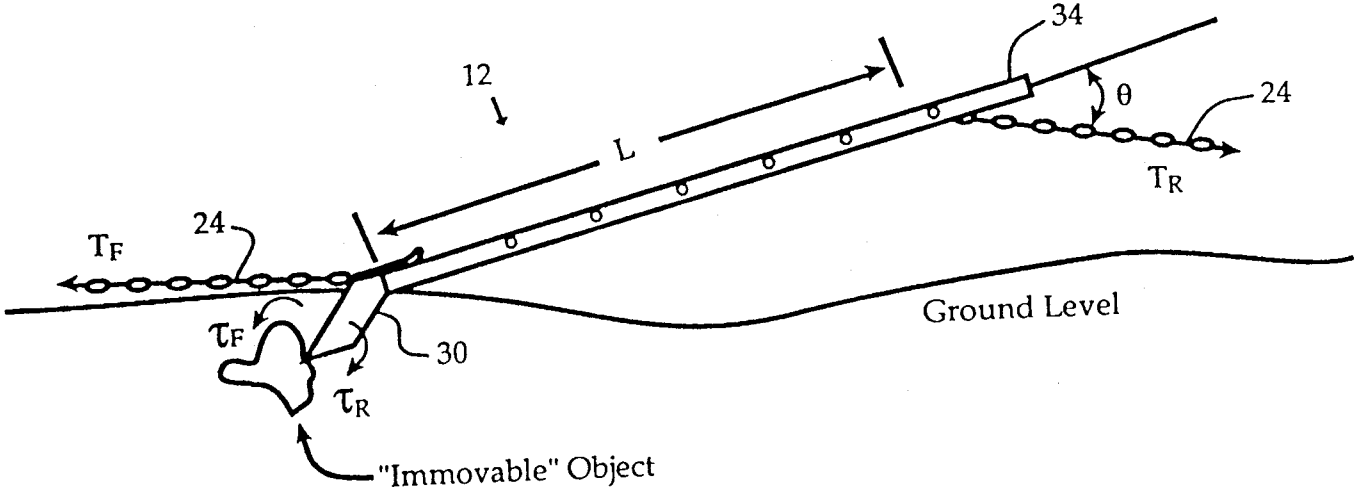
FIG. 4 is a diagram to illustrate the anti-snag mechanism of the plow in accordance with the present invention.

The anti-snag feature of plow 10 is best understood with reference to FIG. 4. The drag force on digging-knife unit 12 is such that the tension $T_R$ on the rear side chains 24 keeps side bracket 34 at ground level unless digging-knives 30 strike an obstruction that would be likely to damage digging-knife unit 12 or stop the towing vehicle if there was no anti-snag release mechanism. When a digging-knife unit 12 hits an "immovable" object the tension in side chains 24 towing it forward, $T_F$, gives rise to a torque $\tau_F$ that wants to rotate it one direction. A reverse torque $\tau_R$, due to the drag tension $T_R$ from harrow 14, wants to rotate snagged digging-knife unit 12 in the other direction. However, $\tau_R < \tau_F$ because there is enough elasticity in harrow 14 to allow a portion of the chain matrix to change its configuration as the snagged digging-knife unit 12 passes over the obstruction. The changing configuration adjusts to allow the rear side chains 24 between the snagged digging-knife unit 12 and harrow 14 to move forward more rapidly than the rear side chains of the other digging-knife units. This built-in elasticity prevents $T_R$ from ever getting large enough to cause $\tau_R > \tau_F$. Snagged digging-knife unit 12 rotates forward until digging-knives 30 are tilted forward to pass over the obstruction. (Note that once digging-knife unit 12 passes over the obstruction $\tau_F$ vanishes except for the normal plowing torque, and $\theta$ immediately returns to zero since $\tau_R$ is nonzero, i.e. $\tau_R = L \times T_R \times \sin\theta$. This prevents digging-knife unit 12 from rolling all the way over in the forward direction.)

If there is more than one row of digging-knife units 12, and a digging-knife unit in the front row hits an obstruction sufficiently embedded to initiate the anti-snag mechanism, the ensuing rotation advantageously pulls the digging-knives of the digging-knife unit in the second row out of the ground.

Figure 5:
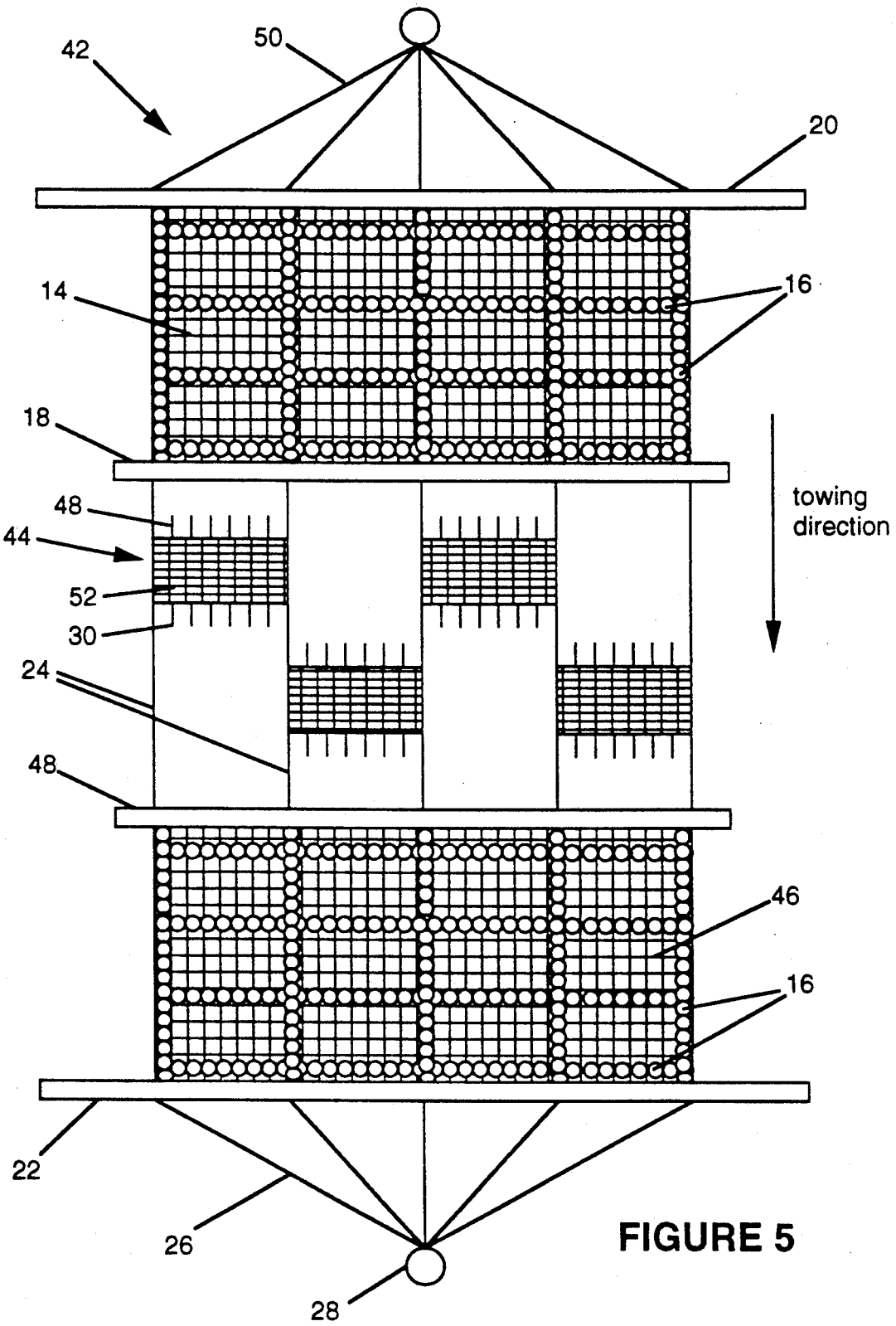
FIG. 5 is a plan view of a symmetrical, anti-snag plow according to the present invention.

FIG. 5 shows a plan view of an anti-snag plow 42 that can be towed in either direction, depending on which side it is on. This is important and convenient for helicopter towing operations because lifting the plow cleans the chain matrix of mines and other debris. Plow 42 can be lifted, cleaned, and put back down on the other side. The towing cable from the helicopter can then be rapidly changed from one side to the other for towing in the other direction.

Plow 42 has a single row of symmetrical digging-knife units 44 that are offset with respect to their neighbors. If the towing direction is as indicated, the parts identified by the same number in FIG. 1 are the same, and all of previous discussion pertaining to these parts is applicable here. As drawn, if plow 42 is rotated about an axis parallel with side chains 24 the towing direction is reversed.

Figure 5A:
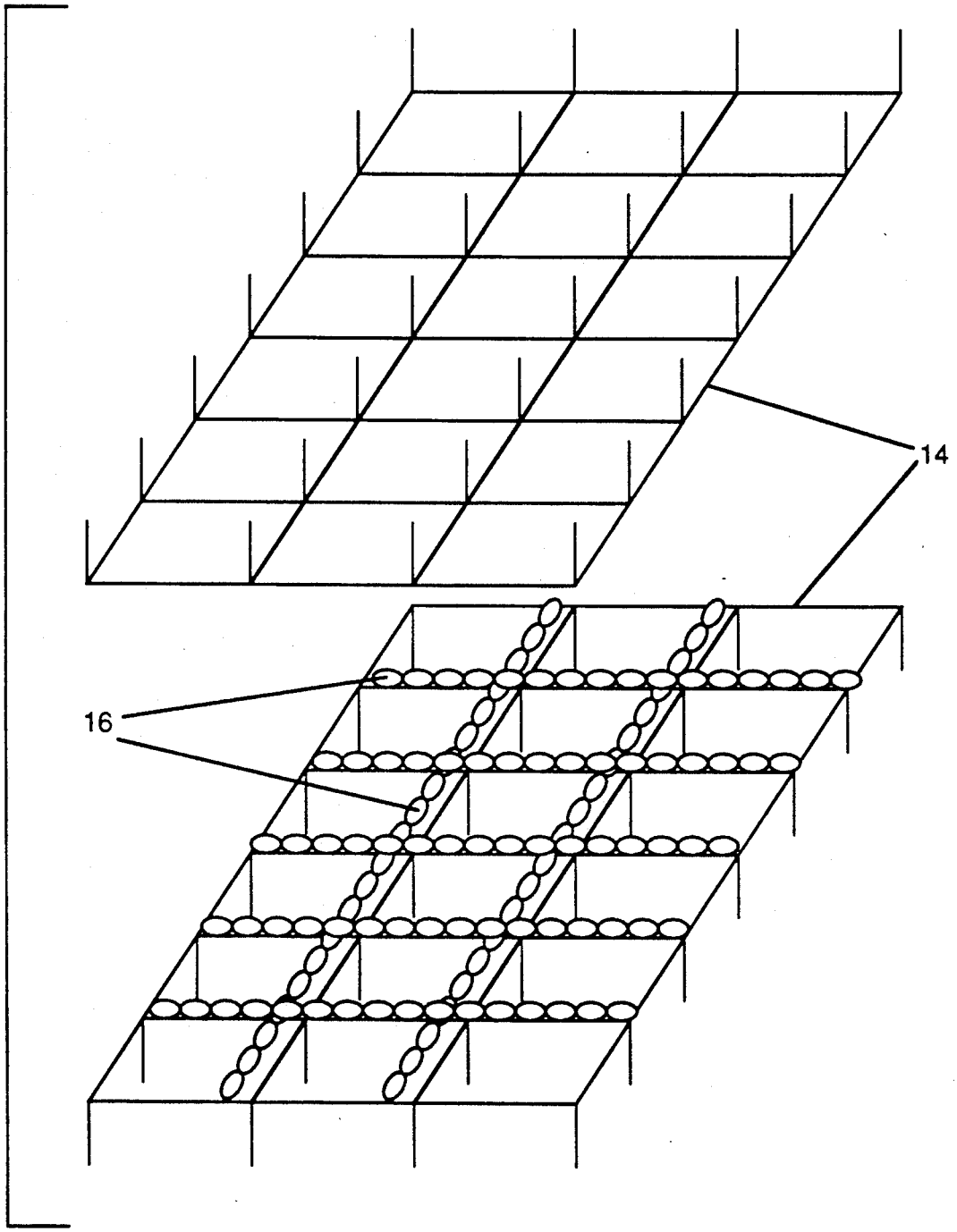
FIG. 5A is a schematic of a double-sided harrow in accordance with the present invention.

Harrows 14 and 46 may be double-sided with tines on the top and bottom, as shown in FIG. 5A. Chain blanket 16 is then sandwiched between the top and bottom harrow layers. In this way the ground is harrowed both before and after the digging-knives pass through. They are each preferably made slightly smaller in this embodiment because of weight considerations. Bar 48 serves as an extra spreader bar, and there is a "vestigial" set of draw cables 50 when plow 42 is towed in the direction indicated.

Figure 6:
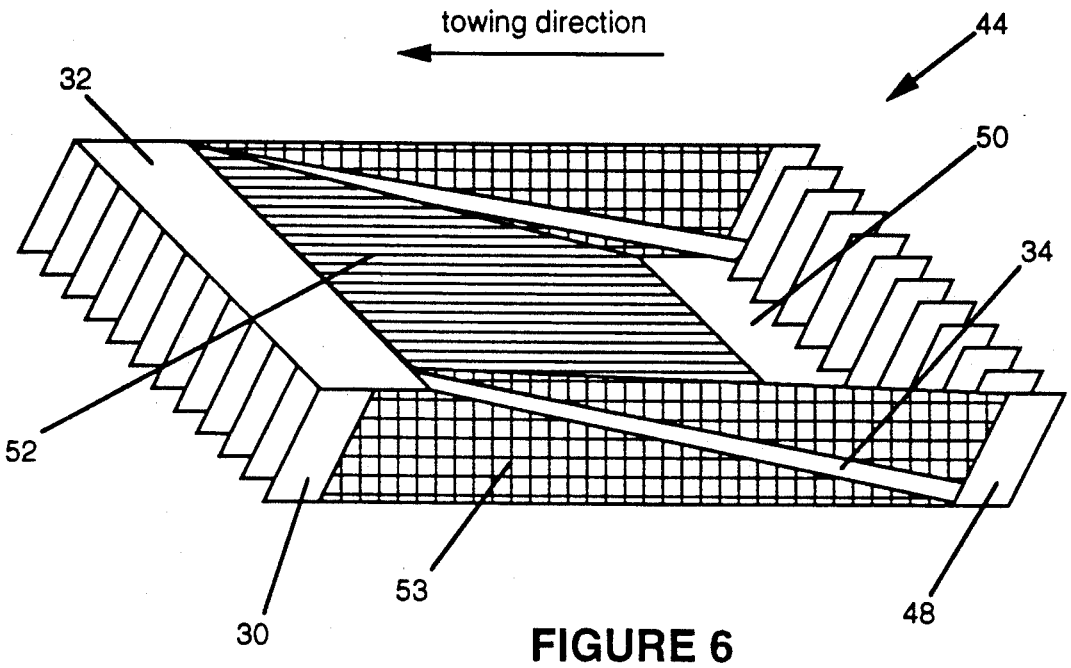
FIG. 6 is a schematic of a reversible digging-knife unit in accordance with the present invention.

A symmetrical digging-knife unit 44 for plow 42 is shown in FIG. 6. In this case the parts identified by the same number in FIG. 2 are the same, and all of previous discussion pertaining to these parts is applicable here. In symmetrical digging-knife unit 44 the reversed top bracket 50 replaces back bracket 36 in the single-sided embodiment. "Mine-catching" basket 52, 53 is modified to allow reversed digging-knives 48 to serve as the back of the basket. Since the basket mesh only runs along side brackets 34 it does not interfere with the operation of digging-knife unit 44.

Figure 7:
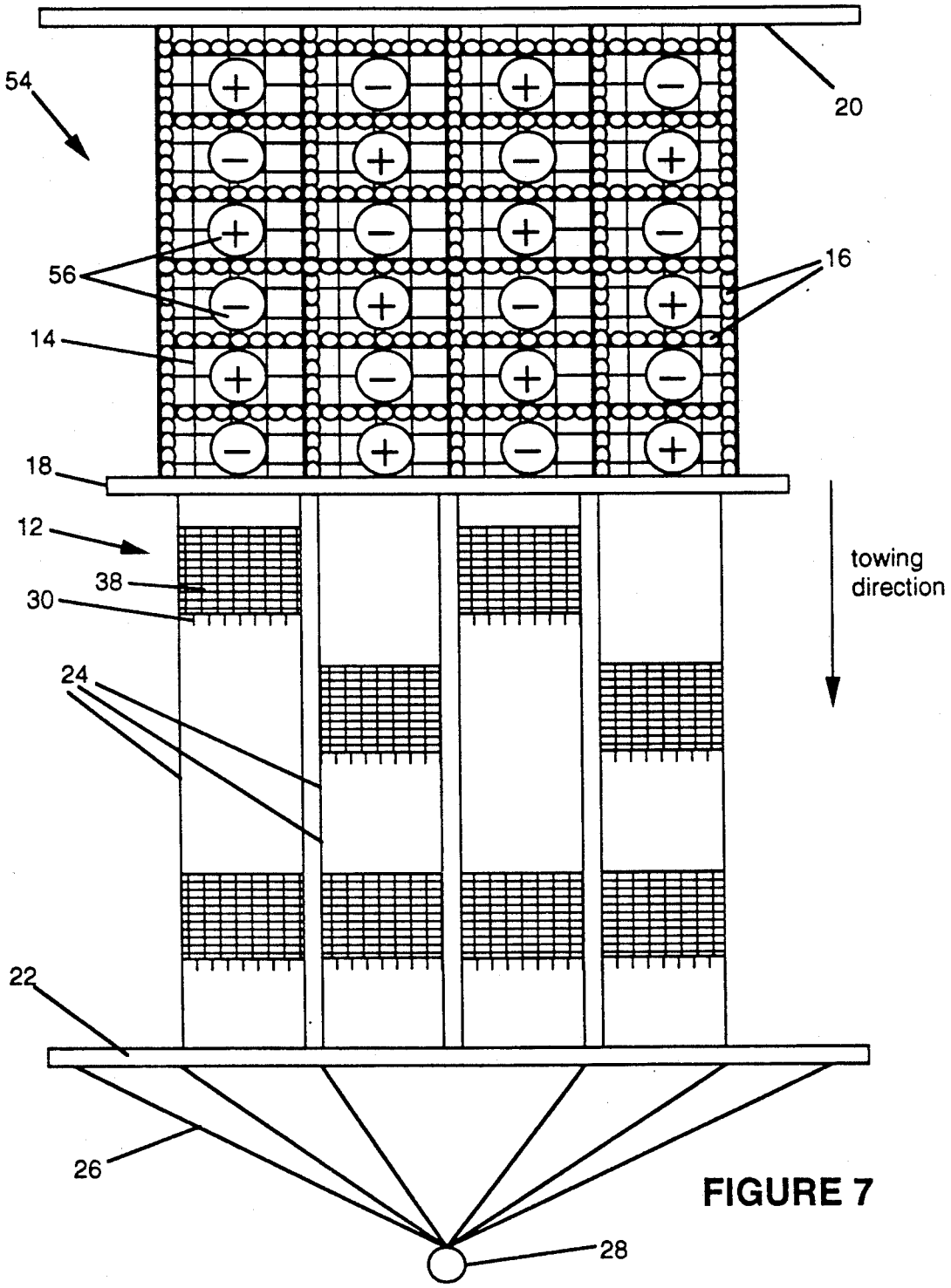
FIG. 7 is a plan view of an anti-snag plow with electromagnetic or pressure wave detonation triggers on the harrow in accordance with the present invention.

An embodiment of the present invention that utilizes harrow 14 as a platform for magnetic or sonic triggering devices is shown in FIG. 7. (Modified anti-snag plow 54 is shown as having two rows of digging-knife units 12 that are not staggered with respect to their neighbors, and each has individual side chains 24-this is another possible configuration in a preferred embodiment.)

Harrow 14 carries triggering devices 56 capable of activating the sophisticated fuses used in modern military mines which are designed to detect a change in the local magnetic field due to an approaching heavy metal object such as a tank, or to detect ground pressure waves from an approaching military vehicle. Triggering devices 56 may generate either magnetic fields, or sonic waves with electricity supplied from a generator carried on the towing unit.

The devices 56 that are shown in FIG. 7 illustrate an embodiment in which devices 56 are coils of electrical wire powered by electrical cables from the towing vehicle, which carries a generator. Coils 56 generate local high-intensity magnetic fields of any desired frequency. In a preferred embodiment the magnetic fields of adjacent coils alternate in polarity. Harrow 14 forms an ideal ferromagnetic conduit so the tips of tines 40 are strong magnetic field sources. In an alternative embodiment devices 56 may include acoustic wave diaphragms to generate sonic wave patterns. These embodiments can be used to trigger the magnetic and acoustic fuses used in modern mines.

The embodiments described above are not intended to limit the scope of the invention. For instance, a steel cable matrix could be used (instead of a chain matrix) in an anti-snag plowing system used for farming. The shape of the digging-knives may be varied for different uses and soil conditions. Other flexible harrows may be used. Many variations are possible. The scope of the invention is only intended to be limited by the following claims.

I claim:

1. An anti-snag plowing system, comprising:

(1) a rigid digging knife unit, comprising:

(a) a plurality of digging knives, (b) a top bracket connected to the knives, (c) at least two side brackets connected to the ends of the top bracket, (d) a back bracket connected to the side brackets, whereby the top, side, and back brackets form a frame, and (e) a basket connected to the frame for catching material turned up by the digging knives;

wherein the digging unit is situated between a towing means and a dragging means;

(2) said towing means connected to the digging unit, comprising:

(a) a draw bar, (b) a plurality of side chains, extending longitudinally from the draw bar to the dragging means, each end of the top bracket being connected to a side chain, wherein the draw bar and top bracket are substantially parallel; and (c) one or more cables connected to the draw bar for attachment to a moving vehicle;

wherein a towing force is applied to the towing means to tow the digging knife unit through a resistive medium that exerts a variable resistive force on the digging unit, whereby the digging unit rotates forward with respect to the direction of towing when the digging unit encounters an obstruction with a resistive force, and the digging unit tilts and passes over the obstruction, and wherein the top bracket has a streamlined surface for the resistive medium to flow over; and (3) said dragging means connected to the side chains, comprising:

(a) a flexible harrow, and (b) a blanket of reinforcing chains covering the top of the harrow.

2. The anti-snag plowing system as recited in claim 1, further comprising:

(4) a first spreader bar situated between the side chains and the dragging means; and (5) a rear spreader bar connected to the dragging means on the end opposite the first spreader bar.

3. The anti-snag plowing system as recited in claim 1, further comprising a plurality of additional digging units, wherein each digging unit is connected between two sides chains and parallel to the draw bar, and arranged in longitudinal rows.

4. The anti-snag plowing system as recited in claim 3, wherein the knives in a digging unit behind a first digging unit are longer than the knives in the first digging unit.

5. The anti-snag plowing system as recited in claim 3, wherein the digging units are staggered in distance from the draw bar.

6. The anti-snag plowing system as recited in claim 3, wherein digging units in a row are connected to side chains that are separate from another row.

7. The anti-snag plowing system as recited in claim 3, wherein two adjacent digging units share a side chain.

8. The anti-snag plowing system as recited in claim 1, wherein the harrow comprises a plurality of interlocking modules.

9. The anti-snag plowing system as recited in claim 1, wherein the knives form about a 28° to 30° forward angle with the vertical when plowing.

10. The anti-snag plowing system as recited in claim 1, wherein the blanket of reinforcing chains comprises:

(i) a plurality of chains, extending longitudinally at the same intervals as the side chains, and (ii) a plurality of cross-chains connecting the longitudinal chains.

11. The anti-snag plowing system as recited in claim 1, wherein the harrow comprises:

(i) a flexible intersecting pattern of rods, and (ii) a plurality of tines formed at intersection points of the rods, wherein the tines point downward and away from the blanket of reinforcing chains.

12. The anti-snag plowing system as recited in claim 1, wherein the harrow has mounted thereon electrical triggering devices selected from the group consisting of generators of magnetic fields and sonic waves.

13. A reversible anti-snag plowing system, comprising:

(1) a reversible digging knife unit having a top and a bottom, comprising:

(a) two sets of digging knives, (b) a top bracket connecting one set of knives, (c) a bottom bracket connecting the other set of knives, wherein the set of knives connected to the top bracket points downward from the top of the digging unit, and the other set of knives connected to the bottom bracket points upward from the bottom of the digging unit, forming a two-sided unit, (d) at least two diagonal side brackets transversely connected to the ends of the top and bottom brackets, whereby the top and bottom brackets and the side brackets form a frame, (e) at least two side panels, which are alongside the side brackets and connected to the ends of the top and bottom brackets, and (f) a diagonal panel connecting the top and bottom brackets, forming a basket in the frame when either set of knives is pointed down to catch material turned up by the digging knives;

(2) a plurality of longitudinally extending side chains, each end of the top and bottom brackets being connected to a side chain;

(3) two dragging means, one connected to each of the opposed ends of the side chains, wherein each dragging means comprises:

(a) a first flexible harrow, (b) a second flexible harrow situated on top of the first harrow, and (c) a blanket of reinforcing chains situated between the first and second harrows;

(4) two towing means, one connected to each of the dragging means, wherein each towing means comprises:

(a) a draw bar, substantially parallel to the top and bottom brackets of the digging unit, and (b) one or more cables connected to the draw bar for attachment to a moving vehicle;

wherein a towing force is applied to the towing means to tow the digging knife unit through a resistive medium that exerts a variable resistive force on the digging unit, whereby the digging unit rotates forward with respect to the direction of towing when the digging knife unit encounters an obstruction with a resistive force, and the set of knives being towed through the resistive medium tilt and pass over the obstruction, and wherein the top and bottom brackets each have a streamlined surface for the resistive medium to flow over; and wherein the system is symmetrical and two-sided, and is towable in one direction and, when flipped over, is towable in the opposite direction.

14. The anti-snag plowing system as recited in claim 13, further comprising a plurality of additional digging units, wherein each digging unit is connected between two side chains and parallel to the draw bar, and are arranged in longitudinal rows.

15. The anti-snag plowing system as recited in claim 14, wherein the digging units are staggered in distance from the draw bar.

16. The anti-snag plowing system as recited in claim 14, wherein digging units in a row are connected to side chains that are separate from another row.

17. The anti-snag plowing system as recited in claim 14, wherein two adjacent digging units share a side chain.

18. The anti-snag plowing system as recited in claim 13, wherein the harrows comprise a plurality of interlocking modules.

19. The anti-snag plowing system as recited in claim 13, wherein each harrow comprises:

(i) a flexible intersecting pattern of rods, and (ii) a plurality of tines formed at intersection points of the rods;

wherein the tines of the first and second harrows point in opposite directions, away from the blanket of reinforcing chains.

20. The anti-snag plowing system as recited in claim 13, further comprising:

(4) a first spreader bar, situated between the side chains and one of the dragging means, and (5) a second spreader bar situated between the side chains and the other dragging means.

21. The anti-snag plowing system as recited in claim 13, wherein the blanket of reinforcing chains comprises:

(i) a plurality of chains, extending longitudinally at the same intervals as the side chains, and (ii) a plurality of cross-chains connecting the longitudinal chains.

22. An anti-snag plowing system for agricultural purposes, comprising:

(1) a rigid digging knife unit, comprising:

(a) a plurality of digging knives, (b) a top bracket connected to the knives, (c) at least two side brackets connected to the ends of the top bracket, and (d) a back bracket connected to the side brackets, whereby the top, side, and back brackets form a frame;

wherein the digging unit is situated between a towing means and a dragging means;

(2) said towing means connected to the digging unit, comprising:

(a) a draw bar, (b) a plurality of side chains extending longitudinally from the draw bar to the dragging means, each end of the top bracket being connected to a side chain, and wherein the draw bar and top bracket are substantially parallel;

(c) one or more cables connected to the draw bar for attachment to a moving vehicle;

wherein a towing force is applied to the towing means to tow the digging knife unit through a resistive medium that exerts a variable resistive force on the digging unit, whereby the digging unit rotates forward with respect to the direction of towing when the digging unit encounters an obstruction with a resistive force, and the digging unit tilts and passes over the obstruction, and wherein the top bracket has a streamlined surface for the resistive medium to flow over;

(3) said dragging means connected to the side chains, comprising a flexible harrow.

23. The anti-snag plowing system as recited in claim 22, further comprising:

(4) a first spreader bar situated between the side chains and the dragging means; and (5) a rear spreader bar connected to the dragging means on the end opposite the first spreader bar.

24. The anti-snag plowing system as recited in claim 22, further comprising a plurality of additional digging units, wherein each digging unit is connected between two side chains and parallel to the draw bar, and arranged in longitudinal rows.

25. The anti-snag plowing system as recited in claim 24, wherein a plurality of digging knife units are connected in a row, and the knives in a digging unit behind a first digging unit are longer than the knives in the first digging unit.

26. The anti-snag plowing system as recited in claim 22, wherein each harrow comprises:

(i) a flexible intersecting pattern of rods, and (ii) a plurality of tines formed at intersection points of the rods.

* * * * *